United States Patent [19]

Graf et al.

[11] 4,212,015

[45] Jul. 8, 1980

[54] PORTABLE MAST FOR RADIO LINK SYSTEMS

[75] Inventors: Robert Graf, Untersiggenthal; René Meier, Neuenhof, both of Switzerland

[73] Assignee: BBC Brown, Boveri & Company Limited, Baden, Switzerland

[21] Appl. No.: 930,007

[22] Filed: Aug. 1, 1978

[30] Foreign Application Priority Data

Aug. 4, 1977 [CH] Switzerland ..... 9566/77

[51] Int. Cl.[2] ..... H01Q 1/10

[52] U.S. Cl. ..... 343/883; 343/901; 52/123

[58] Field of Search ..... 343/880–883, 343/889, 901–903; 52/115, 111, 117, 118, 123, 114, 632; 24/249 DP; 254/107, 132

[56] References Cited

U.S. PATENT DOCUMENTS

| | | | |
|---|---|---|---|
| 1,031,185 | 7/1912 | Krulish | 24/249 DP |
| 1,851,420 | 9/1930 | Carson, Jr. | 226/167 |
| 2,369,195 | 2/1945 | Wiertz | 24/249 DP |
| 2,424,929 | 7/1947 | Haney | 254/132 |
| 2,793,717 | 5/1957 | Camburn | 254/107 |
| 3,320,703 | 5/1967 | Hawthorn et al. | 52/123 |
| 3,688,455 | 9/1972 | Zebuhr | 343/883 |

FOREIGN PATENT DOCUMENTS

| | | | |
|---|---|---|---|
| 303124 | 11/1972 | Austria . | |
| 962197 | 4/1957 | Fed. Rep. of Germany . | |
| 1037098 | 8/1958 | Fed. Rep. of Germany . | |
| 336571 | 4/1959 | Fed. Rep. of Germany . | |
| 78271 | 12/1970 | German Democratic Rep. . | |
| 2167435 | 8/1973 | France . | |
| 2263975 | 10/1975 | France . | |
| 6211 | of 1911 | United Kingdom . | |
| 705598 | 3/1954 | United Kingdom . | |
| 141186 | 3/1960 | U.S.S.R. | 343/883 |
| 229618 | 3/1969 | U.S.S.R. | 343/883 |

*Primary Examiner*—David K. Moore

*Attorney, Agent, or Firm*—Oblon, Fisher, Spivak, McClelland & Maier

[57] ABSTRACT

A portable radio link system mast, particularly for use in the field, employing mast tube elements which are lifted, one after the other, by means of a lifting device installed in the head of the stand and, after a certain height is reached, are connected with always the next mast tube element. The lifting device consists of three frictionally self-locking pawls arranged on top of each other, a carrying pawl, a lowering pawl and a lifting pawl, which permit a slipless lifting, lowering and locking of the mast tube elements in connection with springs. A cardigan cam lever with a feeler stud draws attention to a wrong connection of the mast tube elements, and a mast tube element in the range of the lifting device can only be pushed out of the head of the stand after a correct contact is established with the following mast tube element.

2 Claims, 20 Drawing Figures

PORTABLE MAST FOR RADIO LINK SYSTEMS

BACKGROUND OF THE INVENTION

1. Field of the Invention

This invention concerns a portable mast, particularly for radio link systems, with a stand and rotary head of stand, a mast tube lifting and lowering device installed in the head of the stand, telescopic mast tube elements, which can be locked, and staying elements for the fixing of the mast at the site.

2. Description of the Prior Art

Known portable radio link masts suffer mainly from the fact that their lifting device installed in the head of the stand, by means of which the individual mast tube elements are lifted one by one in order to add the next telescoping mast tube element, is complicated and also subject to disorders.

This is due to the fact that the lifting device usually has a toothed wheel with rack and pinion and the function thereof is restricted when dirt enters the system. Particularly when utilized for military purposes, this disadvantage can play a decisive role.

SUMMARY OF THE INVENTION

It is therefore an object of this invention to provide a novel portable mast which avoids the above-described deficiencies.

This and other objects are achieved according to the invention by providing a novel mast employing a lifting and lowering device in which three ring-shaped friction pawls surround the mast tube and are disposed within the head of the stand in the longitudinal direction of the mast tube elements, i.e., one on top of the other, the upper friction pawl serving as a carrying pawl, the center friction pawl serving as a lowering pawl and the lower friction pawl serving as a hoisting pawl. The upper friction pawl has a manually operable lowering cam in effective connection with the center friction pawl and has a swivel connection at its side opposite to the lifting cam. A manually operable lifting cam, being in effective connection with the lower friction pawl, has a swivel connection in the head of the stand. Spring elements are provided between the lower hoisting pawl and the center friction pawl and hold the two pawls in contact with the mentioned two cams. Means are provided to fix the lower hoisting pawl as soon as a lower face of a mast tube element, not being in contact with the adjacent face of the next following mast tube element, has reached a certain position within the head of the stand.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
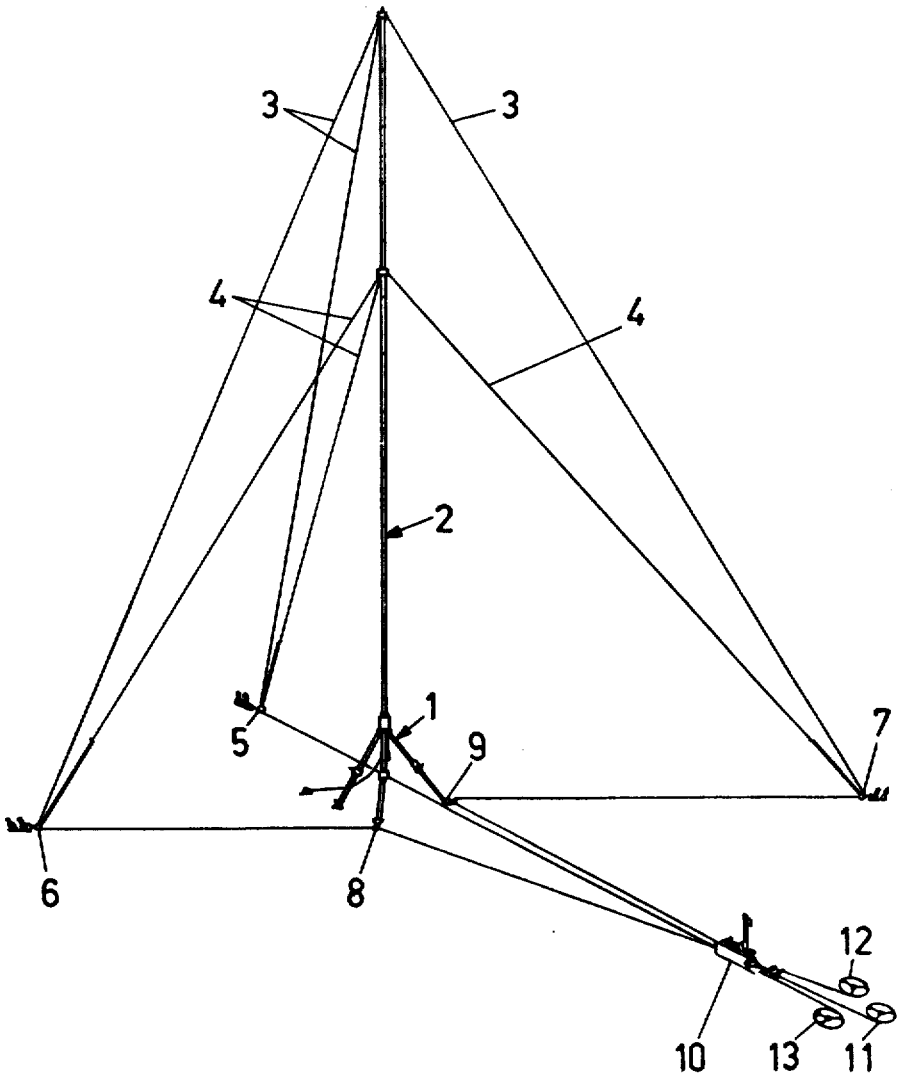
FIG. 1 is a view of a mast according to the invention, mounted at the site, ready for operation.

Referring now to the drawings, wherein like reference numerals designate identical or corresponding parts throughout the several views, and more particularly to FIG. 1 thereof, the numeral 1 designates the stand, 2 the mast tube, 3 guy ropes which lead to a rope winder 10 of known design over guide pulleys 5, 6, 7, 8, 9 with which the ropes 3 can be tightened individually or together. The numerals 11, 12 and 13 indicate rope reels to wind the ropes 3. In order to guarantee the stability of the mast tube2 when a stronger wind is blowing, the ropes 4 are fastened to the anchoring points 5, 6 and 7 and tightened by hand.

Figure 2:
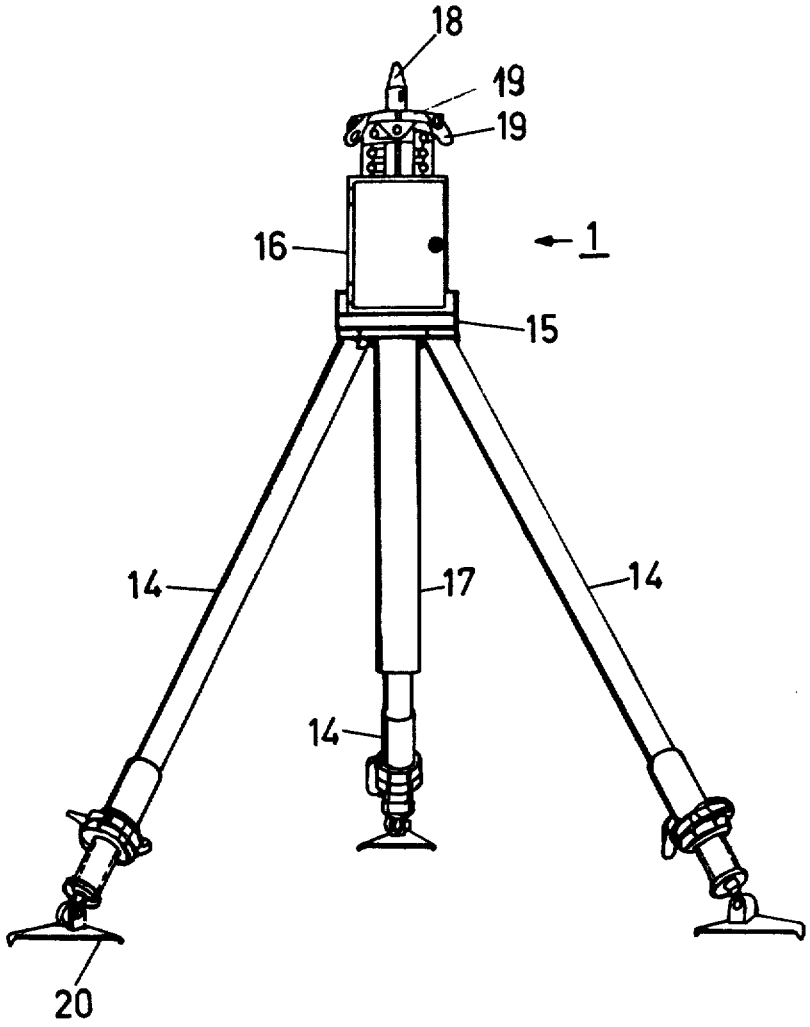
FIG. 2 is a view of the stand of the mast according to FIG. 1 with the top mast tube element the point of which has a tapered tenon to receive the radio link unit.

The stand 1 shown in FIG. 2 has three legs 14, adjustable in their lengths, the adjusting mechanism of which is described further below. On a common cover plate 15, the head of the stand 16 is pivoted in order to be able to turn the mast 2, the upper mast tube element 17 of which is shown in its initial position in FIG. 2 in the desired azimuth direction. At the upper end of the mast tube element 17, one can also see a tapered tenon 18 as well as two shackle plates 19 for the purpose of fastening the guy ropes 3 and 4. Hinge-jointed claws 20 guarantee the safe standing of the legs of the stand 14.

Figure 3:
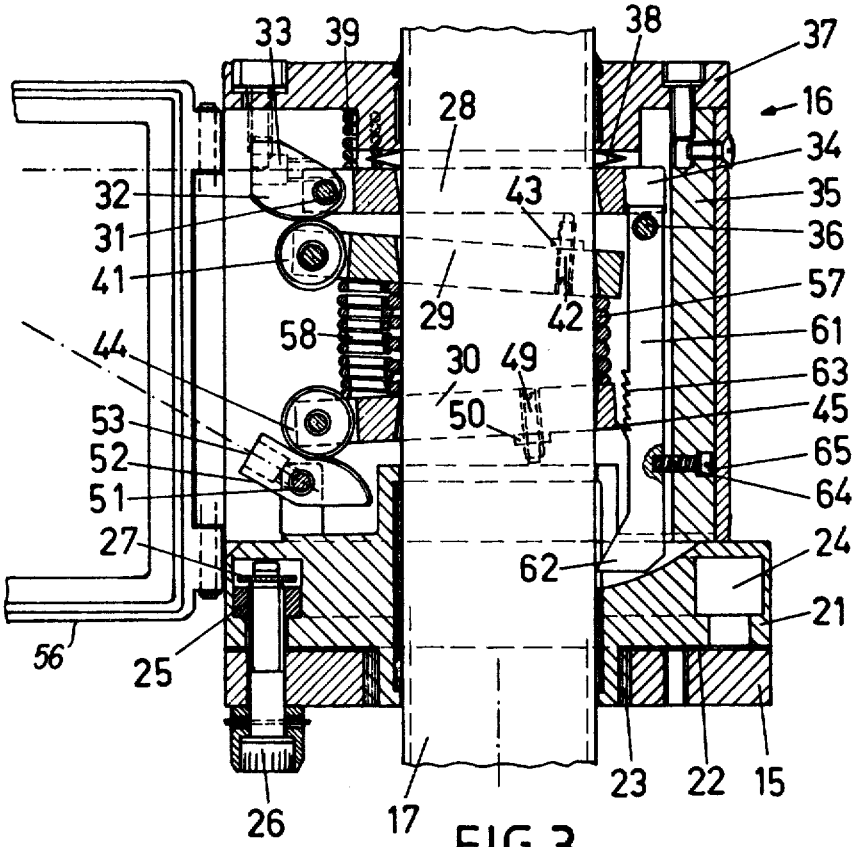
FIG. 3 is a cross-sectional view of the head of the stand with the lifting and lowering device for the mast tube.
Figure 4:
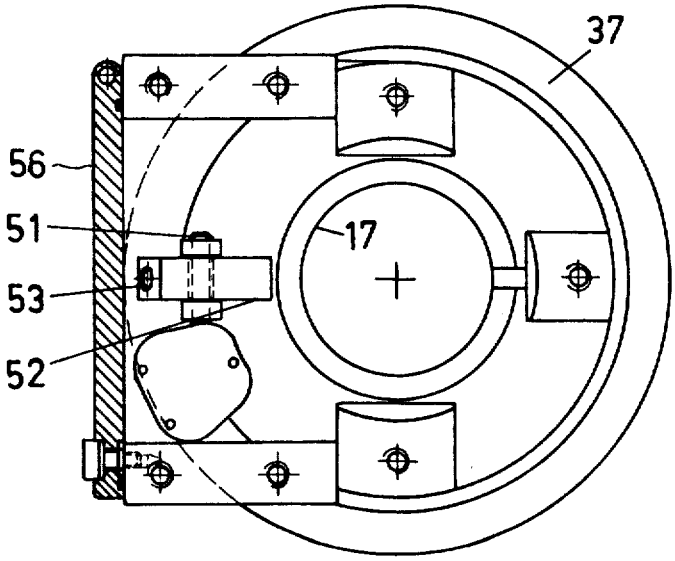
FIG. 4 is a top view of the head of the stand.
Figure 5:
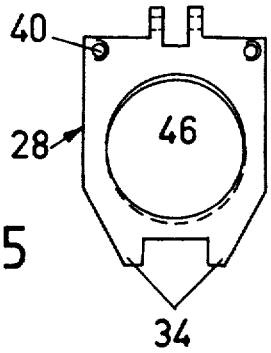
FIGS. 5 to 10 are views of the three friction pawls, each time from the top and in profile.
Figure 6:
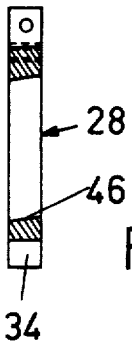

FIG. 3 shows the head of the stand 16 with the lifting and lowering device installed within it for the mast tube 2 as well as with the mast tube element 17. A base plate 21 is pivoted on the cover plate 15 whereby a plastic disk 22 receives the vertical axial thrust and a plastic bushing 23 the horizontal forces. An annular tee-slot 24 is provided in the base plate 21 in which there are slide rings 25 with internal thread permitting the clamping of the base plate 21 in connection with screws 26 projecting through the cover plate 15. A disk 27 fastened to the end of the screws prevents the screw 26 from being completely turned out.

Of the three friction pawls, the upper pawl 28 serves the purpose of carrying the mast tube, the center pawl 29 of lowering and the upper pawl 30 of lifting the mast tube 17. Accordingly, these pawls are called carrying pawl, lowering pawl or lifting pawl, respectively. These pawls are shown in FIGS. 5 to 10 individually from the top and in profile. The carrying pawl 28 has a lowering cam 32, pivoting around a bolt 31, with a tapped hole 33 into which a lever tube can be screwed to operate a lowering cam 32. On the side opposite to the lowering cam 32, the carrying pawl 28 has two tongues 34 (see FIG. 6) with which the carrying pawl rests on a bolt 36 supported in the casing 35.

There are two plate springs 38, arranged in series, between a casing cover 37 and the carrying pawl 28 and, on the side of the lowering 32, there are two compression springs 39 which are installed between the casing cover and carrying pawl. For this purpose, two guide pilots 40 are provided in the carrying pawl 28 as can be seen from FIG. 5.

Figure 7:
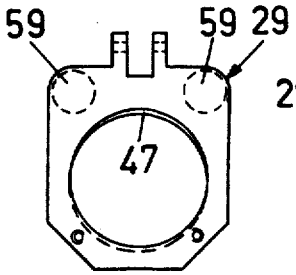
Figure 8:
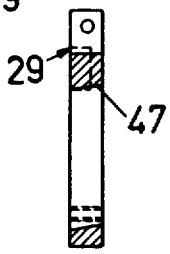

The lowering pawl 29 shown in detail in FIGS. 7 and 8 carries on one side a roller 41 interacting with the lowering cam 32 and, on the opposite side, two screwed pins 42 with nuts 43 for the purpose of fixing the screwed pins which serve as center of rotation of the pawl.

Figure 9:
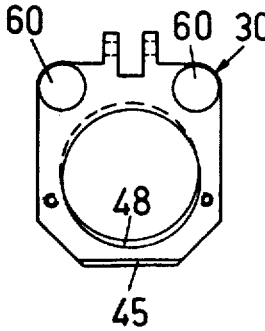
Figure 10:
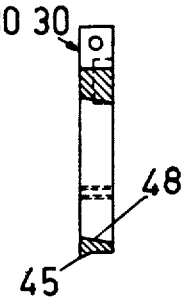

The lifting pawl 30 shown in FIGS. 9 and 10 is, essentially, mirror inverted in comparison with the lowering pawl 29 but has additionally a straight edge 45 on the side opposite to its roller 44.

The pawls 28, 29 and 30 are provided with bore holes 46, 47 or 48, respectively, inclined by a few degrees to the plane of the pawls, which surround the mast tube and permit canting and self-locking on the mast tube in the known manner. The lifting pawl 30 has also two screwed pins 49 and nuts 50 for their fixation whereby these screwed pins serve also the purpose of centers of rotation for the pawl.

Beneath the lifting pawl 30, there is a lifting cam 52, pivoted on a bolt 51, with a tapped hole 53 which has the purpose of receiving a lever tube. The two lever tubes 54 and 55 for the lowering cam 32 or the lifting cam 52, respectively, which are schematically shown in FIGS. 11 and 12, can be introduced through an opening in the head of the stand 16, which can be closed by a little door 56.

A compression spring 57, surrounding the mast tube element 17, as well as two smaller compression springs 58, the ends of which are placed in recesses 59 or 60, respectively, are installed between the lowering pawl 29 and the lifting pawl 30. The springs 58 are not shown in FIGS. 11 and 12.

A cardigan cam lever 61 is located on the side opposite to the lowering cam 32 which is pivoted around the bolt 36. Its lower part is designed as a stud 62 and, in its center part, it has a row of notches 63 which have the purpose of engaging with the edge 45 of the lifting pawl 30. A compression spring 64 is placed into the wall of the casing 35, which is held by a screw 65. The spring 64 pushes the stud 62 of the cardigan cam lever against the outer surface of the mast tube element 17.

Figure 11:
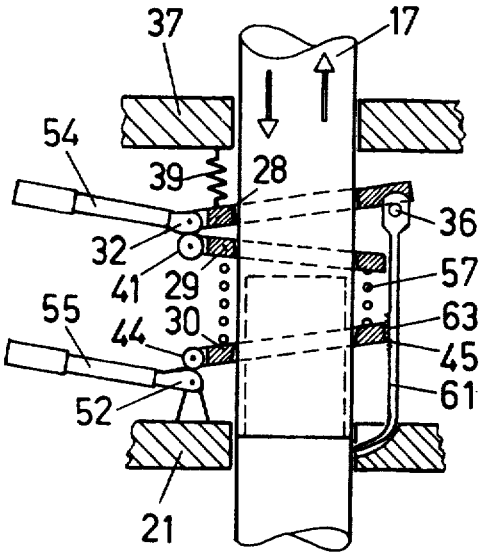
FIGS. 11 and 12 are functional diagrams of the lifting and lowering device.
Figure 12:
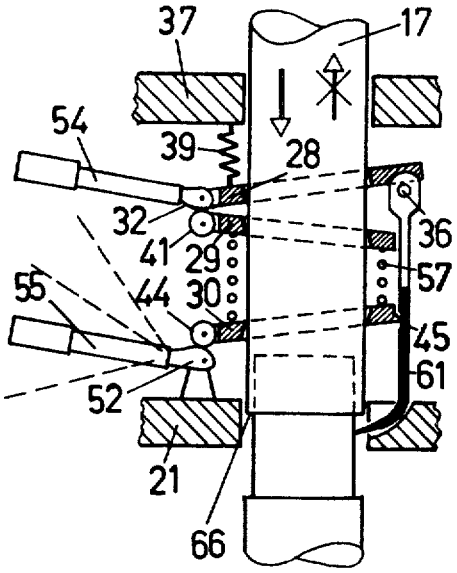
Figure 14:
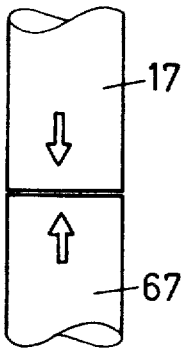
FIGS. 14 to 19 show the manipulations required for the connecting of the mast tube elements; and, FIG. 20 is a view of one foot of the stand in partial cross-section.
Figure 15:
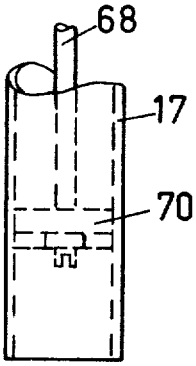
Figure 17:
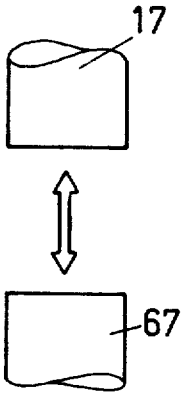
Figure 18:
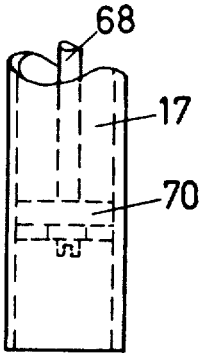
Figure 16:
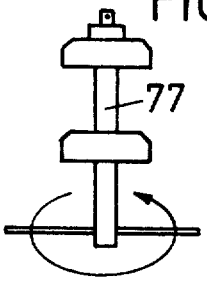
Figure 19:
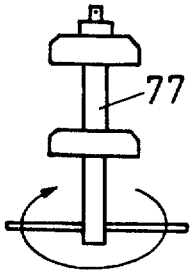

The mode of operation of the lifting and lowering device can be derived from FIGS. 11 and 12. When pushing down the lever tube 55, the lifting cam 52 pushes first the roller 44 upward and thus the lifting pawl 30 as well whereby it is simultaneously pivoted clockwise against the force transmitted from the spring 58 to the lowering pawl 29. This movement is transmitted to the carrying pawl 28, over the roller 41 and the lowering cam 32, which turns also clockwise and thus releases the mast tube element 17 which pushes upward due to the lever tube 55 being further pushed down which raises the lifting pawl 30 which has, in the meantime, seized the mast tube element in a clamping manner. With the lever tube 55 being subsequently pulled upward, this process is reversed whereby, initially, the carrying pawl 28 becomes effective and, subsequently, the lifting pawl releases the mast tube element.

For the lowering of the mast tube the lever tube 54 is swung downwardly whereby, initially, the lowering pawl 29 gets a clamping effect on the mast tube element 17 and, subsequently, the lifting pawl 30 and the carrying pawl 28 are released so that the mast is lowered when the lever tube 54 is further pushed down.

The plate springs 38 and the compression springs 39, 57 and 58 serve the purpose of tightening the pawls towards each other and to hold them in the position required for the operation.

The two screwed pins 42 and 49 with the pertinent nuts 43 or 50, respectively, serve the purpose of adjusting the relative position of the pawls, particularly of adapting to the mast tube diameter to balance diameter tolerances.

The cardigan cam lever 61 has the task to hold the lifting pawl 30, as shown in FIG. 12, when the following mast tube element 67 is not properly connected with the latter, i.e. it does not touch jointlessly the face 66 of the upper tube element with its own face. In this case, the spring 64 (FIG. 3) pushes the cardigan cam lever into the position shown in FIG. 12 whereby the edge 45 (FIG. 3) of the lifting pawl 30 engages in one of the notches 63.

When the lifting pawl is activated in this position through the lifting cam 52, it continues swinging up and down until the tube elements are orderly connected, i.e. until their adjacent faces touch each other without leaving a gap. This is a preventive measure in case of an erroneous assembly of the mast tube and it prevents the respectively lowest mast tube element being lifted out of the head of the stand in case of inattentiveness.

Figure 13:
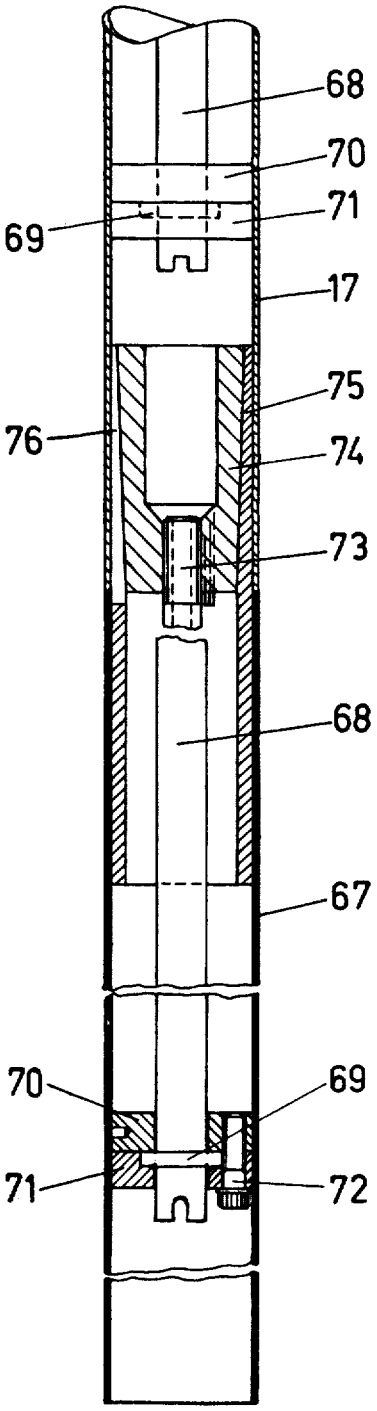
FIG. 13 is a schematic cross-sectional view of the connecting elements of the mast tube.

FIG. 13 shows the connecting elements for the assembly of the mast tube element. They consist of a tie rod 68 with a collar 69 and a screw thread 73 which interacts with the internal thread of a clamping cone 74. The tie rod 68, whose head has a slot to receive a corresponding key 77, rests with its collar 69 on the support ring 70 fastened in the mast tube element and is secured in the axial direction by means of a cover 71 fastened by screws 72.

The alignment of the mast tube elements 17 and 67 to be connected with each other is guaranteed by means of an expanding bushing 75, connected with the tube element 67. The lower part of the bushing 75 is cylindrically designed and the upper part has a inner cone into which the clamping cone 74 is placed. The expanding bushing 75 has a longitudinal slot 76 into which a stud (not shown) of the clamping cone 74 is engaged, acting as a protection against torsion. When tightening the tie rod 68 by means of the key 77 shown in FIGS. 16 and 19, the upper mast tube element 17 is centered and locked vis-a-vis the lower mast tube element 67. FIGS. 14 to 19 show schematically the manipulations when connecting or separating, respectively, the two adjacent mast tube elements 17 and 67.

Figure 20:
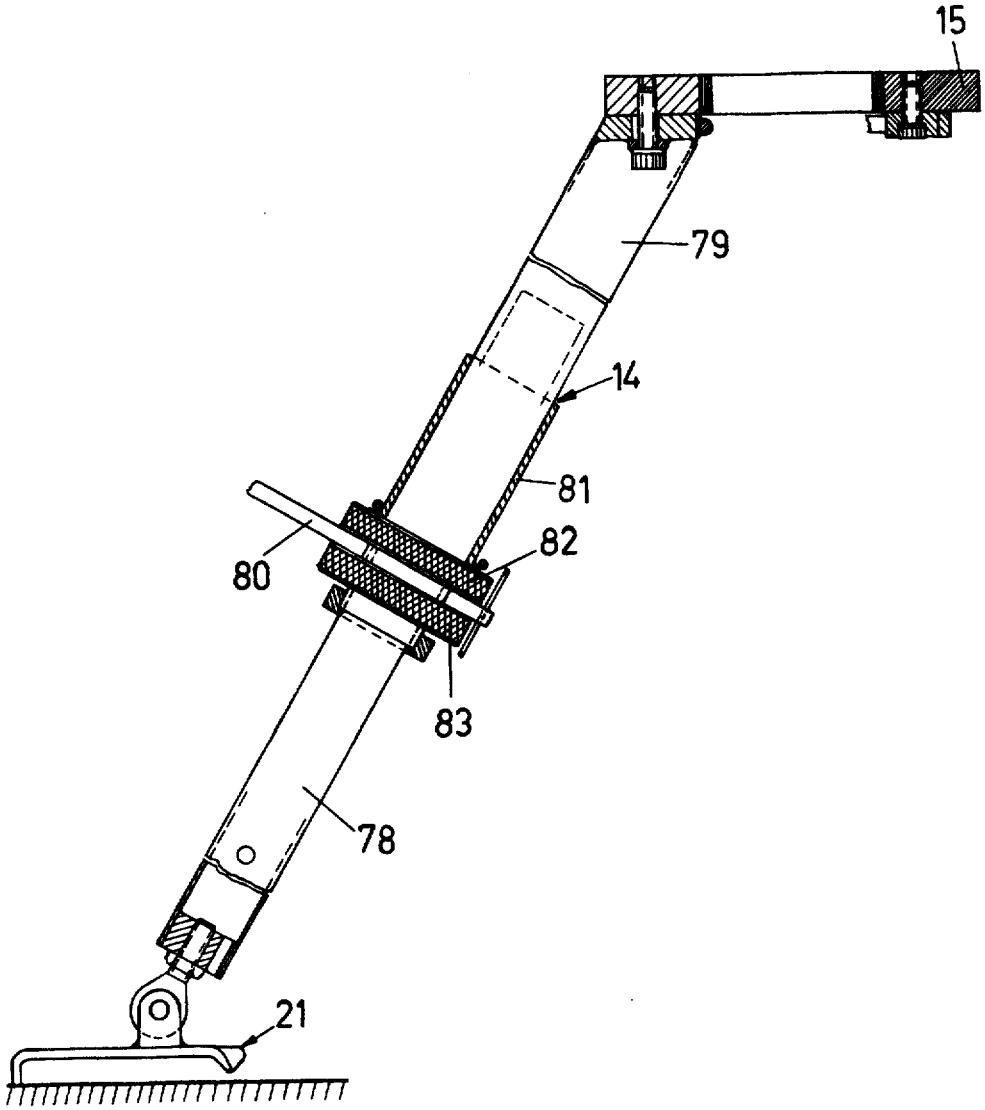

FIG. 20 shows a leg 14 of the stand and the adjusting mechanism for the setting of the length of the leg. It has a base plate 21 which is pivoted on an adjustable tube 78 and enables the safe standing of the stand. This tube 78 is provided, in its upper part, with a number of cross bore holes to receive a bolt 80 whose ends, projecting on both sides, can be moved in the axial direction of the leg of the stand in two longitudinal slots, diametrically opposite each other, of an outer guide tube 79. On the guide tube 79 provided with an external thread, a protective tube 81 connected with a knurled nut 82 is provided above the bolt 80 and a knurled nut 83 is provided below the bolt 80. By tightening the two knurled nuts 82 and 83 against the bolt 80, the adjusted length of the leg can be fixed and the leg of the stand can be made rigid.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A portable mast, particularly for radio link systems, having a stand and a rotary head of the stand, a mast tube lifting and lowering device installed in the head of the stand, telescopic mast tube elements forming a mast tube which can be locked, and staying elements for the fixing of the mast at the site, wherein said lowering and lifting device comprises:

three ring-shaped friction pawls surrounding the mast tube and adapted for forced-locking, self-arresting connection with said mast tube, disposed within the head of the stand in the longitudinal direction of the mast tube elements and adapted to raise and lower said mast tube when said pawls are tilted, with an upper mast carrying pawl disposed above a center mast lowering pawl which in turn is disposed above a lower mast lifting pawl;

a manually operable lowering cam connected to said upper carrying pawl and in effective connection with said center lowering pawl at a bearing portion of said lowering pawl to tilt said lowering pawl, said upper carrying pawl supporting said mast tube and having a swivel connection to a pin at its side opposite said lowering cam;

a manually operable lifting cam in effective connection with said lower lifting pawl at a bearing portion of said lifting pawl and having a swivel connection in the head of the stand;

a plurality of spring elements provided between the lower lifting pawl and the center lowering pawl for holding said lower lifting pawl and said center lowering pawl in contact with said lowering and lifting cams; and catch lever means for fixing the lifting pawl as soon as a lower face of a mast tube element not being in contact with the adjacent face of a next following mast tube element, has reached a certain position within the head of the stand.

2. A mast according to claim 1 wherein said catch lever means is pivoted around said pin of said carrying pawl, said lever having a stud and notches, and said lower lifting pawl having an edge for engaging and being held by said catch lever when said next following mast tube element is not flush with the preceding mast tube element, and wherein said catch lever means is provided with a thrust coil adapted to bias said notches against said edge of said lower lift pawl.

* * * * *